United States Patent [19]

Puchovsky

[11] 4,251,037

[45] Feb. 17, 1981

[54] COIL FORMING APPARATUS WITH AXIALLY ADJUSTABLE MANDRELS

[75] Inventor: Melicher Puchovsky, Dudley, Mass.

[73] Assignee: Morgan Construction Company, Worcester, Mass.

[21] Appl. No.: 93,830

[22] Filed: Nov. 13, 1979

[51] Int. Cl.[3] ..... B21C 47/00

[52] U.S. Cl. ..... 242/81; 242/83

[58] Field of Search ..... 242/81, 82, 83, 84, 242/79; 140/1

[56] References Cited

U.S. PATENT DOCUMENTS

| | | | |
|---|---|---|---|
| 2,198,644 | 4/1940 | Wettengel | 242/81 |
| 3,439,882 | 4/1969 | Woodrow | 242/81 |
| 3,618,871 | 11/1971 | Gilvar | 242/84 |
| 3,648,736 | 3/1972 | Hill | 242/81 |
| 3,926,382 | 12/1975 | Sieurin | 242/81 |

*Primary Examiner*—Edward J. McCarthy

*Attorney, Agent, or Firm*—Thompson, Birch, Gauthier & Samuels

[57] ABSTRACT

A coil forming apparatus has a pair of mutually perpendicular elongated mandrels mounted on a hub. Rotation of the hub about an axis perpendicular to the mandrel axes results in the mandrels being moved between a collecting station at which they protrude vertically from the hub to receive product rings from an overlying delivery device, and a discharge station at one side of the hub at which they protrude horizontally to accommodate axial removal of the coils. The mandrels are axially adjustable relative to the hub, and each mandrel has oppositely disposed ends adapted to receive rings from the delivery device. A retracting device is employed to withdraw each mandrel across the rotational axis of the hub from the discharge station to an intermediate station on the opposite side of the hub.

11 Claims, 14 Drawing Figures

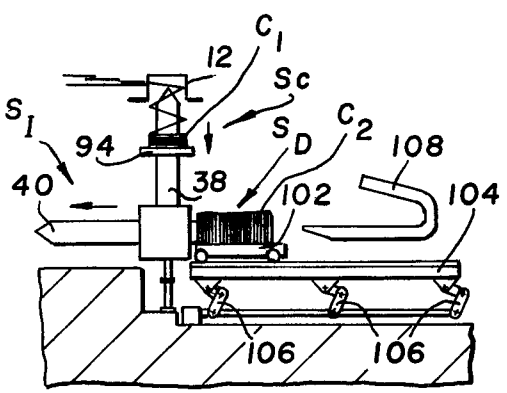
Fig. 7A
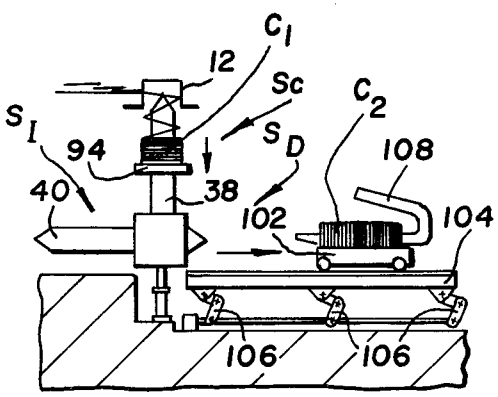
Fig. 7B
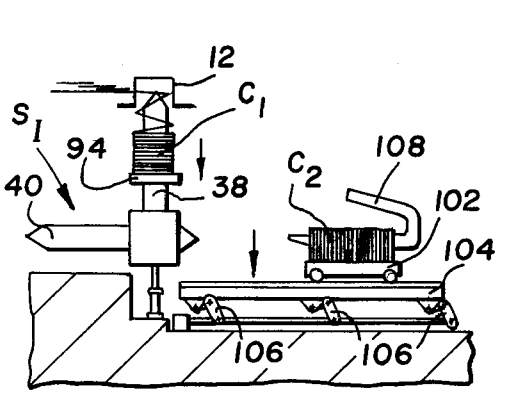
Fig. 7C
Fig. 7D
Fig. 7E
Fig. 7F

COIL FORMING APPARATUS WITH AXIALLY ADJUSTABLE MANDRELS

BACKGROUND OF THE INVENTION

This invention relates generally to rod or bar rolling mills wherein after the rolling operation, the elongate mill product is preliminarily formed into rings which are finally collected into large cylindrical coils. The invention is concerned in particular with an apparatus employed in the collection of such rings into coils.

One known coil forming device is shown in U.S. Pat. No. 3,439,882. This type of device employs four mutually perpendicular axially fixed mandrels supported on a central hub. The hub is rotatably indexed to bring each mandrel to an upstanding position at a collecting station where rings are received axially thereon from an overlying delivery device and accumulated in coil form. Thereafter, by rotatably indexing the hub through another 90°, the loaded mandrel is brought to a horizontally disposed position at a discharge station on one side of the hub, while another empty mandrel is moved into an upstanding operatative position at the collecting station. With this type of device, there is always one empty mandrel protruding downwardly from the hub in opposed relationship to the operatively positioned upstanding mandrel at the collecting station. One decided drawback associated with this type of arrangement is the necessity for providing a large well or pit beneath the hub to accommodate the mandrels as they rotate into and out of their downwardly protruding positions. The excavation and foundation costs associated with providing such pits contribute markedly to the high costs of the equipment.

Another known prior art device is disclosed in U.S. Pat. No. 3,737,050. Here, a pair of axially fixed mutually perpendicular mandrels are rotated about an inclined axis which bisects the angle defined by the mandrel axes. Although this type of arrangement substantially minimizes excavation costs by maintaining the path of mandrel travel about mill floor level, this advantage is to a large extent offset by a number of other disadvantages. For example, because the inclined rotational axis of the hub bisects the angle formed by the mandrel axes, a large tipping moment is produced each time a full coil is transferred from the coil forming station to the discharge station. With relatively heavy coils which frequently weight 6,000 lbs. or more, this tipping moment produces severe stresses which in turn make it necessary to employ extremely heavy housing shafts and bearings. This translates into high capital costs.

Another drawback with this type of equipment stems from the fact that the somewhat conical rotational path of the mandrels makes it difficult to employ a cage or other like structure to radially confine the rings as they accumulate in coil form at the coil forming station. Thus, in order to produce a coil having the desired substantially uniform cylindrical shape, the rings must be relatively tightly packed around the mandrels. When such coils subsequently are stripped from the mandrels, the frictional contact between the inner ring surfaces and the mandrels sometimes damages the rings.

Finally, neither of the above-described prior art devices allows the mandrels to be axially raised above their normal path of rotation into closer proximity to the overlying ring delivery device. Under certain circumstances, depending on the type of ring delivery device being employed. if the gap between the mandrel upper ends and the ring delivery device is too great, instead of being axially received around the mandrels the rings can "hang up", causing a malfunction which seriously disrupts the operation of the apparatus.

SUMMARY OF THE INVENTION

The present invention also employs a pair of mutually perpendicular mandrels carried on a central hub. The hub is rotatably indexed about a horizontal axis perpendicular to the mandrel axes to move the mandrels between a collecting station at which each mandrel protrudes vertically to receive product rings from an overlying delivery device, and a discharge station on one side of the hub at which each manrel protrudes horizontally to accommodate axial coil removal. However, unlike the prior art devices discussed above, the mandrels of the present invention are axially adjustable relative to the hub, and each mandrel is provided with identical oppositely disposed ends adapted to receive product rings from the delivery device. A retracting device is provided for axially withdrawing each mandrel across the rotational axis of the hub from the discharge station to an intermediate station on the opposite side of the hub. Thereafter, upon rotation of the hub through 90°, the empty mandrel at the intermediate station is moved into an operative position at the collecting station while the other fully loaded mandrel is moved from the collecting station to the discharge station. This is accomplished without having either mandrel protrude downwardly to any appreciable extent beneath the mill floor level, thus avoiding costly excavations. Also, by rotating the hub about a horizontal axis which is perpendicular to the mandrel axes, high tipping moments are avoided and a more balanced structure is provided which is turn makes it possible to employ less costly bearings and associated stationary supporting structures. Thus, the savings realized from avoiding costly excavations are substantially retained.

The present invention also incorporates means for axially adjusting the vertically disposed mandrels at the coil forming station in order to bring the mandrel upper ends into closer proximity to the overlying ring delivery device. This insures a smoother and more reliable axial transfer of rings onto the mandrels, thereby improving operational reliability.

These and other objects and advantages of the present invention will become more apparent as the description proceeds with the aid of the accompanying drawings.

BRIEF DESCRIPTION OF THE DRAWINGS

FIGS. 7A–7F are schematic illustrations depicting the operational sequence of the apparatus.

DETAILED DESCRIPTION OF THE INVENTION

Figure 1:
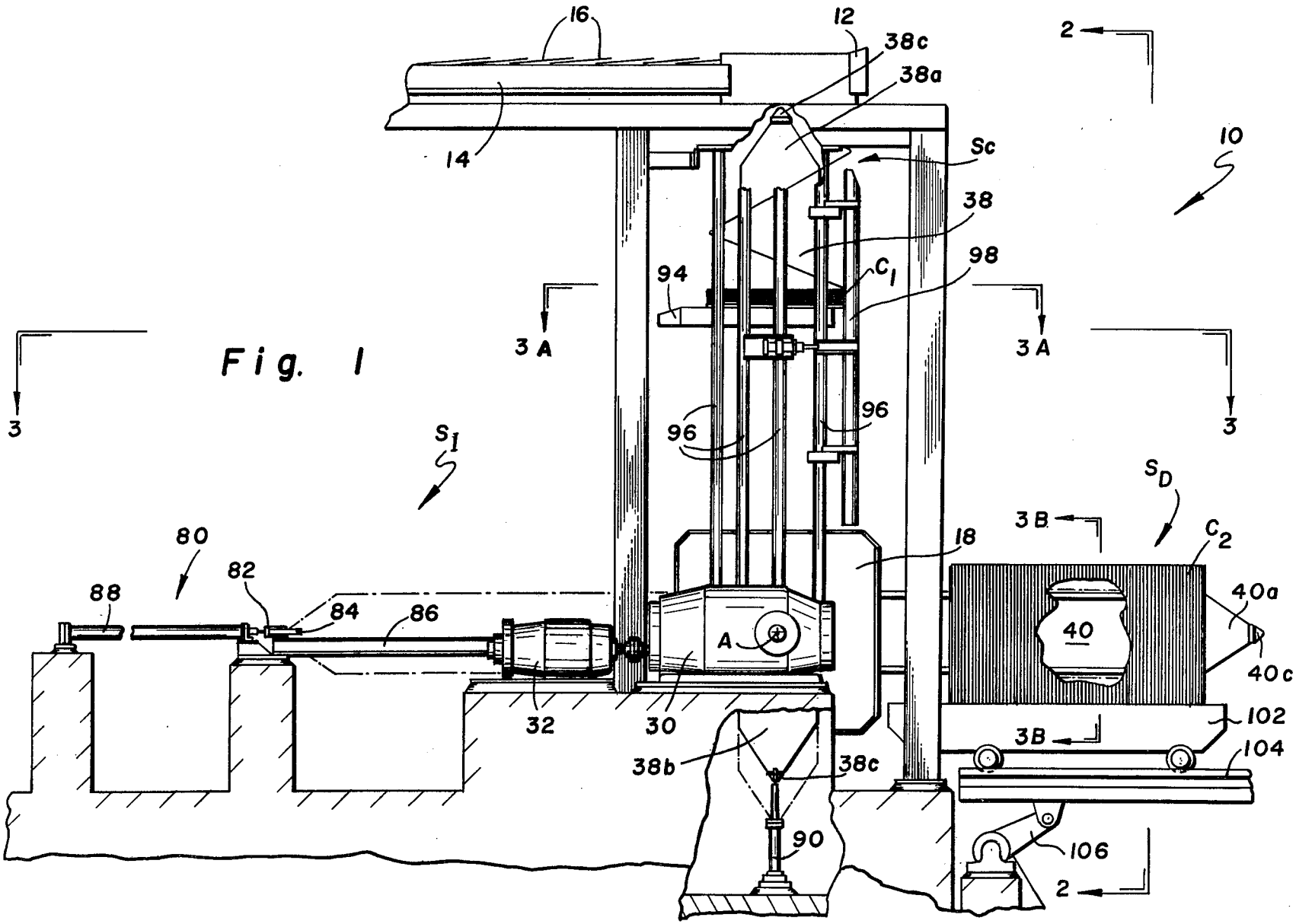
FIG. 1 is a view in side elevation of a coil forming apparatus embodying the concepts of the present invention, with portions broken away to illustrate components which would otherwise be hidden from view.
Figure 2:
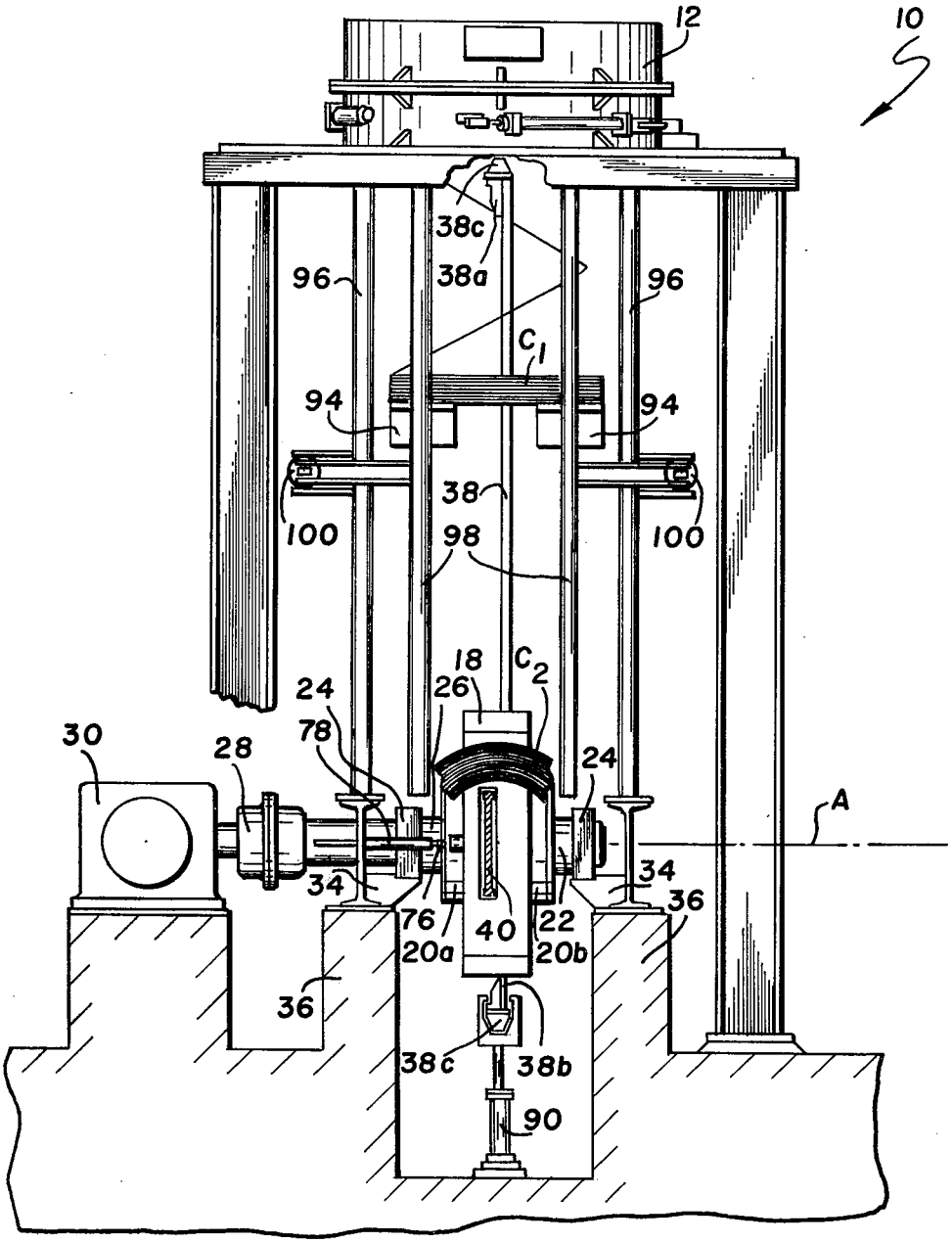
FIGS. 2, 3, 3A and 3B are sectional views taken respectively along lines 2—2, 3—3, 3A—3A and 3B—3B of FIG. 1.
Figure 3:
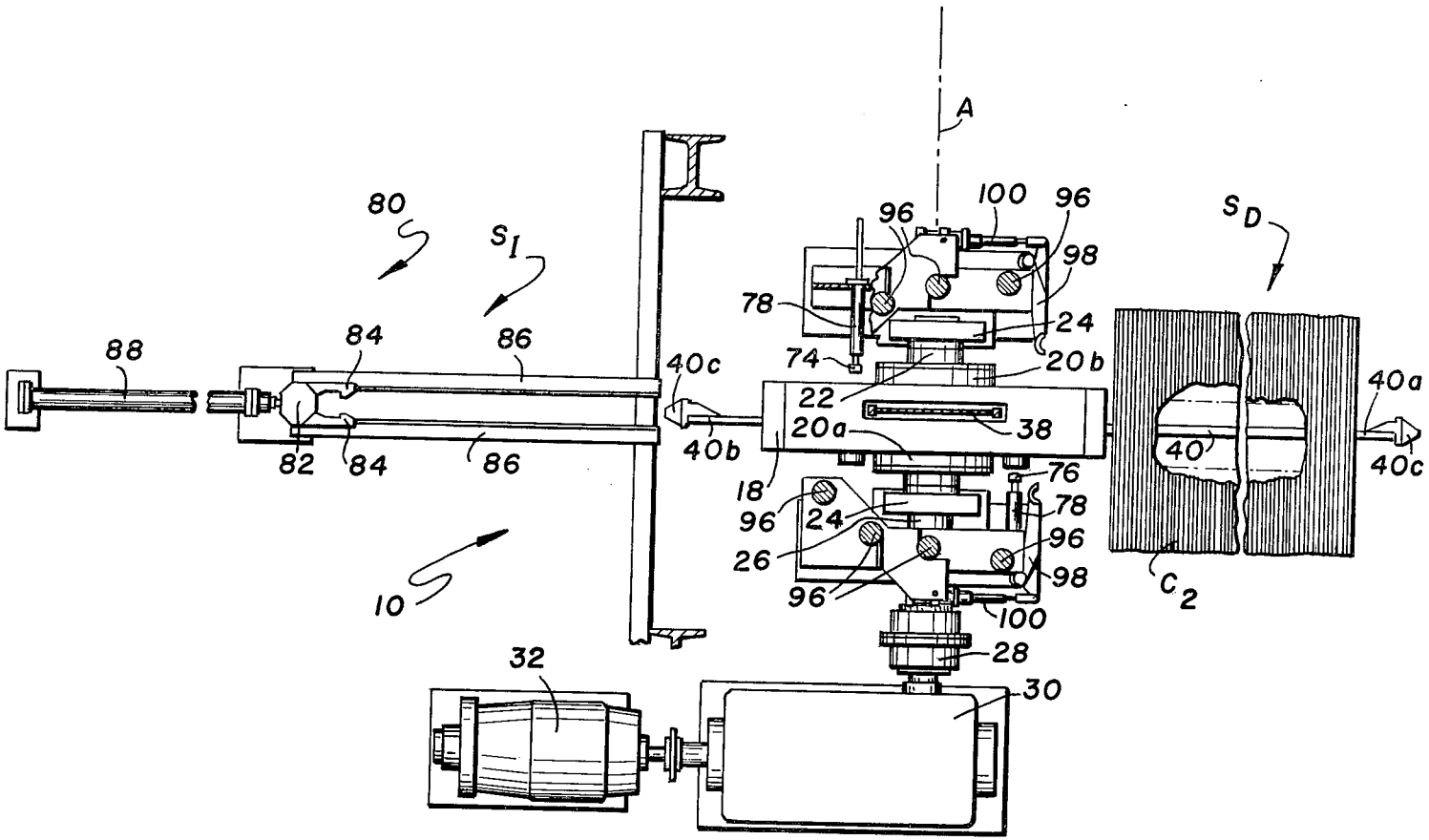

Referring initially to FIGS. 1–3, an apparatus in accordance with the present invention is generally indicated at 10 at a position underlying a conventional ring delivery device 12. In the drawings, the ring delivery device is shown at the end of a moving chain conveyor 14 of known design carrying a spencerian formation of overlapping rod rings 16. The rings leave the end of the conveyor and descend vertically through the delivery device 12 in a generally helical pattern. It will be understood that the conveyor 14 and delivery device 12 are not part of the present invention. Any other type of arrangement, such as for an example a conventional laying head, can provide the source of descending product rings.

The present invention includes a hub 18 having a pair of laterally disposed trunnions 20*a*, 20*b*. Trunnion 20*b* is provided with a stub shaft 22 rotatably supported in a bearing 24. Trunnion 20*a* is provided with a shaft 26 arranged coaxially with stub shaft 22. Shaft 26 is rotatably supported in another bearing 24 and is connected by means of a coupling 28 to the output shaft of a gear reducer 30. Gear reducer 30 is driven in a conventional manner by a motor 32. The bearings 24 are supported on brackets 34 carried on foundation pedestals 36. Motor 32 acts through gear reducer 30 and coupling 28 to rotate hub 18 in a clockwise direction as viewed in FIG. 1 about a horizontal axis depicted schematically "A".

Hub 18 carries a pair of elongated mandrels 38, 40. Mandrel 38 has identical tapered end sections 38*a*, 38*b*, each of which terminates at a nose 38*c*. Mandrel 40 is likewise provided with identical tapered end sections 40*a*, 40*b*, each terminating at a nose 40*c*.

Figure 4:
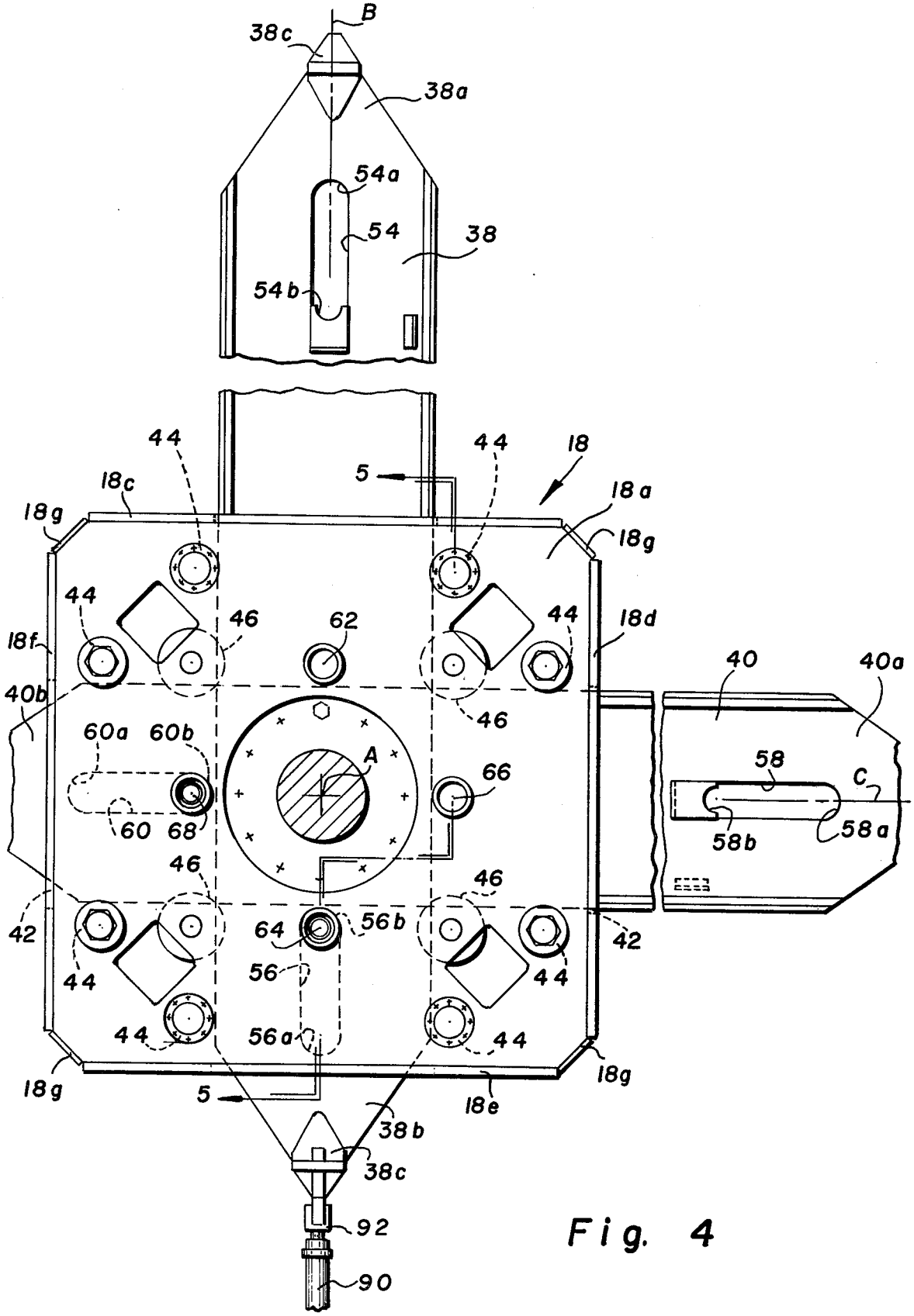
FIG. 4 is a side elevational view on an enlarged scale of the hub with the vertically disposed mandrel axially lowered to a rest position on a mandrel stop pin.
Figure 5:
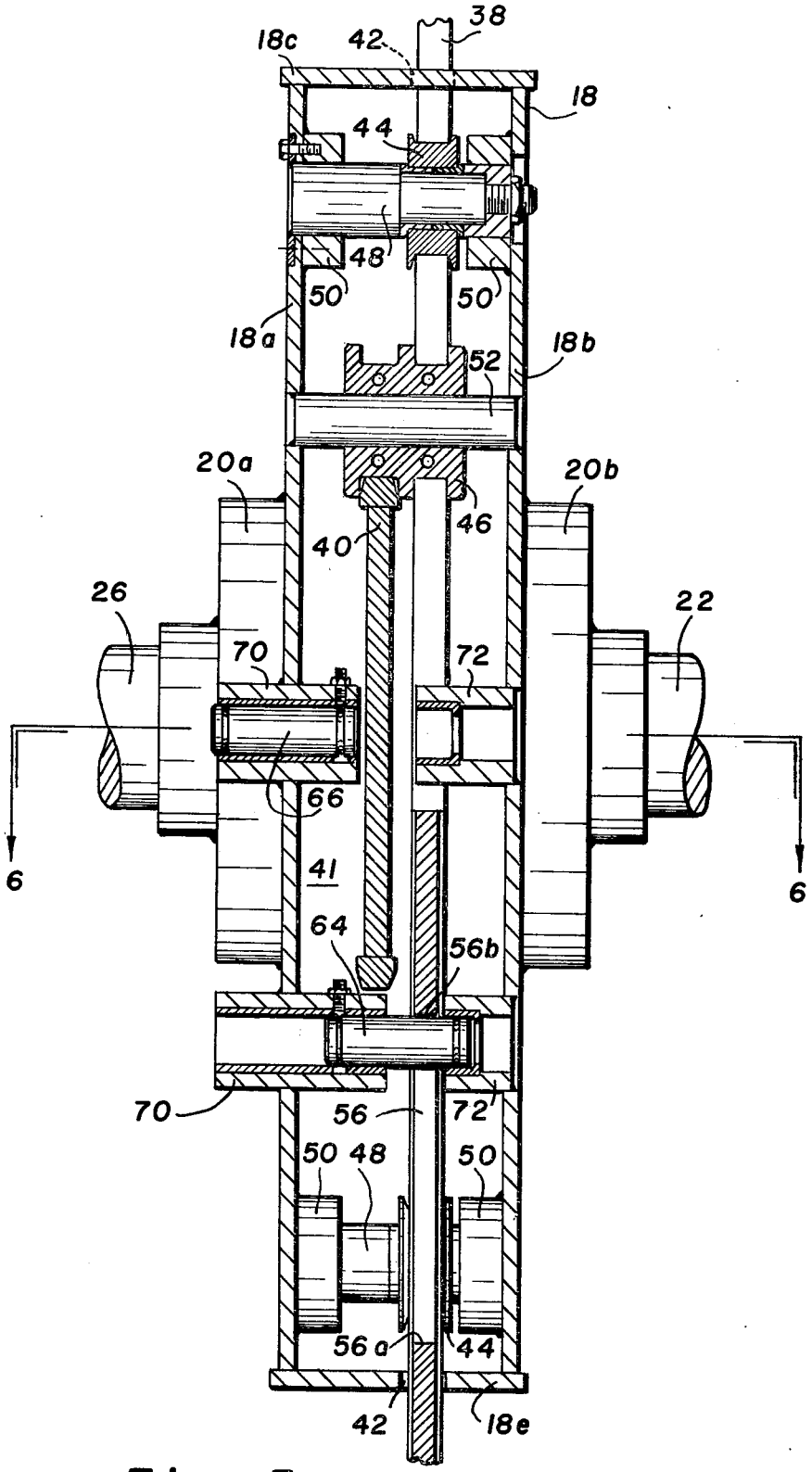
FIG. 5 is a sectional view taken along line 5—5 of FIG. 4.
Figure 6:
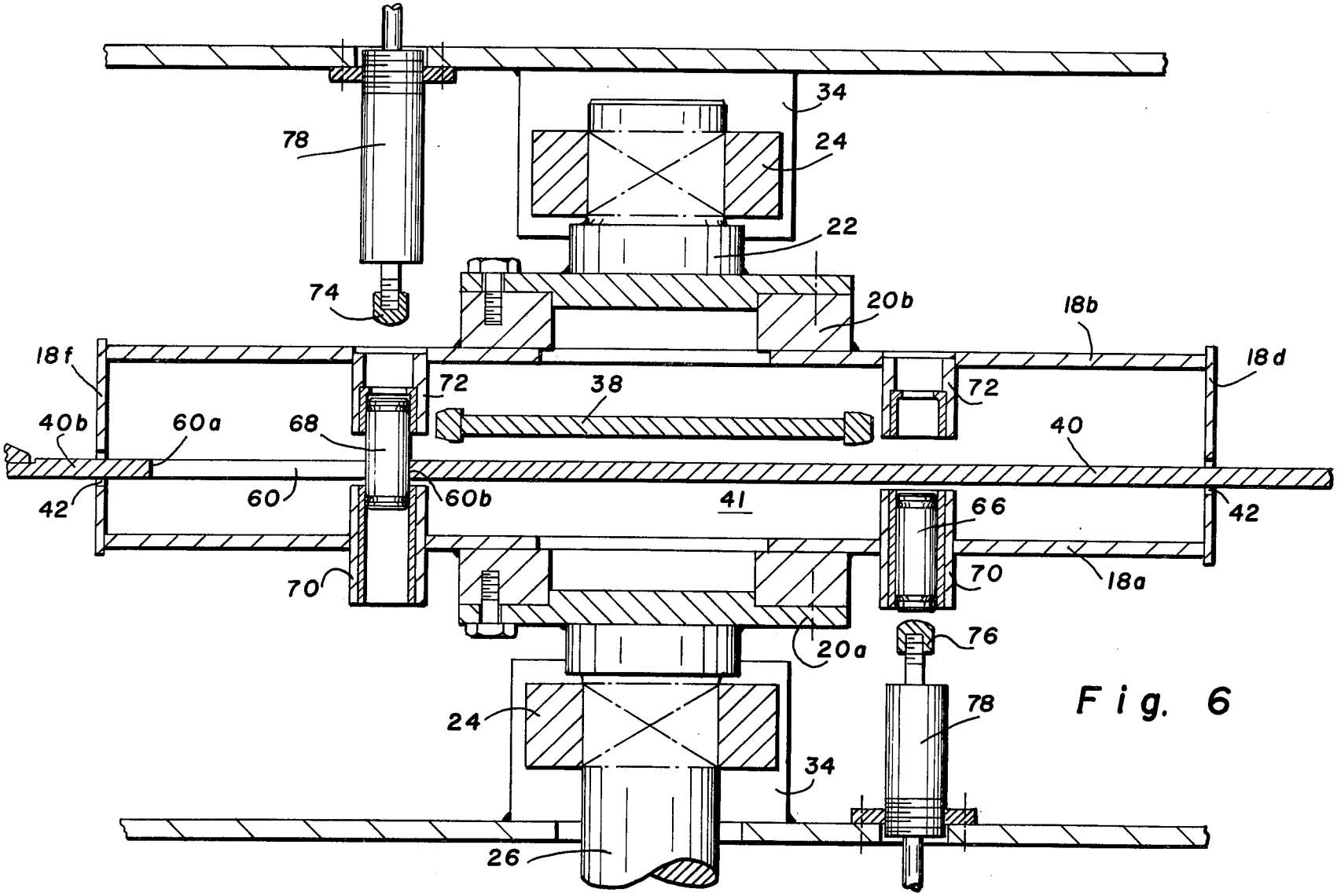
FIG. 6 is a sectional view taken along line 6—6 of FIG. 5.

As can best be seen in FIGS. 4–6, hub 18 basically consists of opposed side plates 18*a*, 18*b* interconnected by end plates 18*c*, 18*d*, 18*e*, 18*f* and corner plates 18*g*. These plates cooperate to define an interior chamber 41. Mandrel 38 extends vertically across chamber 41 and through aligned openings 42 in the opposed end plates 18*c* and 18*e*. In like fashion, mandrel 40 extends horizontally across chamber 41 through aligned openings 42 in opposed end plates 18*d* and 18*f*. The mandrels are each supported for axial movement relative to the hub 18 on single-groove rollers 44 which are assisted by double-groove guide rollers 46. The single-groove rollers 44 are carried on shafts 48 extending between internal bosses 50 on the hub side plates 18*a*, 18*b*. Similarly, the double-groove guide rollers 46 are carried on shafts 52 also extending between the hub side plates 18*a*, 18*b*. It will thus be seen that the mandrels 38, 40 are supported on the hub 18 for axial movement in parallel planes, with the respective axes "B" and "C" of mandrels 38, 40 being perpendicular to each other and to the rotational axis "A" of the hub.

Mandrel 38 has elongated axially extending slots 54, 56, each respectively terminating at opposed ends 54*a*, 54*b* and 56*a*, 56*b*. Mandrel 40 is likewise provided with slots 58, 60, each respectively terminating at opposed ends 58*a*, 58*b* and 60*a*, 60*b*. The mandrel slots 54, 56, 58, 60 are each arranged to cooperate with one of four mandrel stop pins 62, 64, 66 and 68. The stop pins are each axially shiftable across the operating planes of the mandrels 38, 40 between aligned bushings 70, 72 carried by the hub side plates 18*a*, 18*b*. For example, in FIG. 5, stop pin 66 is fully retracted from the operating planes of the mandrels 38, 40 and is located entirely within bushing 70, whereas stop pin 64 extends across the operating planes of the mandrels, with its opposite ends supported respectively in aligned bushings 70, 72. Stop pin 64 thus extends through mandrel slot 56, with the axial position of the mandrel being such that the slot end 56*b* is in contact with the pin.

Reciprocal movement of the stop pin 62–68 is accomplished by means of plungers 74, 76 arranged exteriorily of the hub 18. The plungers 74, 76 may be reciprocally actuated by any convenient means such as for example pneumatically actuated piston-cylinder units 78.

Axial manipulation of the horizontally positioned mandrels 38, 40 is accomplished by means of a retraction device generally indicated at 80 (see FIGS 1 and 3). This device includes a gripping head 82 having a pair of spring-loaded pivotal jaws 84. The gripping head 82 is reciprocally movable along tracks 86 by means of a piston-cylinder unit 88. When a horizontally disposed mandrel (for example mandrel 40) is to be retracted from the delivery station $S_D$ to the intermediate station $S_I$ on the opposite side of the hub, piston-cylinder unit 88 is actuated to advance the gripping head 82 until its spring-loaded jaws 84 encounter and snap over the adjacent mandrel nose 40*c*. Then, plunger 74 is actuated to push stop pin 68 clear of slot 60. Then, piston-cylinder unit 88 retracts the gripping head 82 back to its original position, thus pulling mandrel 40 out of the coil at delivery station $S_D$ and into the position shown by dot-dash lines in FIG. 1 at the intermediate station $S_I$. Once this has been accomplished, plunger 76 is actuated to insert mandrel stop pin 66 in slot 58. This completes the readjustment of horizontally disposed mandrel 40. Axial adjustment of the mandrels 38, 40 in the vertical position is accomplished by means of another piston-cylinder unit 90 provided with a support head 92. Any such vertical adjustment is of course limited to the lengths of the mandrel slots 54, 56, 58 and 60.

It will thus be understood that the condition of the apparatus as depicted in FIGS. 1–3 is as follows: mandrel 38 is vertically disposed at the collecting station "$S_C$" in axial alignment with the ring delivery device 12. The mandrel 38 has been axially raised by the piston-cylinder unit 90 to bring the uppermost tapered section 38*a* and nose 38*c* into close proximity to the underside of delivery device 12 so as to insure a smooth axial transition of rings 16 onto the mandrel. The extent of this elevation is limited by engagement of slot ends 56*a* with stop pin 64. The rings being received around mandrel 38 are accumulating in coil form at $C_1$ on a descending split coil plate 94. Vertical adjustment of the coil plate 94 may be accomplished by any known means such as for example an elevator arrangement similar to that illustrated in FIG. 6 of U.S. Pat. No. 3,648,736. The coil $C_1$ is radially confined by fixed vertical posts 96, and by a pair of pivotal gates 98 controlled by piston-cylinder units 100. The companion mandrel 40 is in a horizontal position at the discharge station $S_D$ located to one side of the hub 18. The fully formed coil $C_2$ on mandrel 40 has been received on a transfer car 102 mounted for movement along rails 104.

Figure 3B:
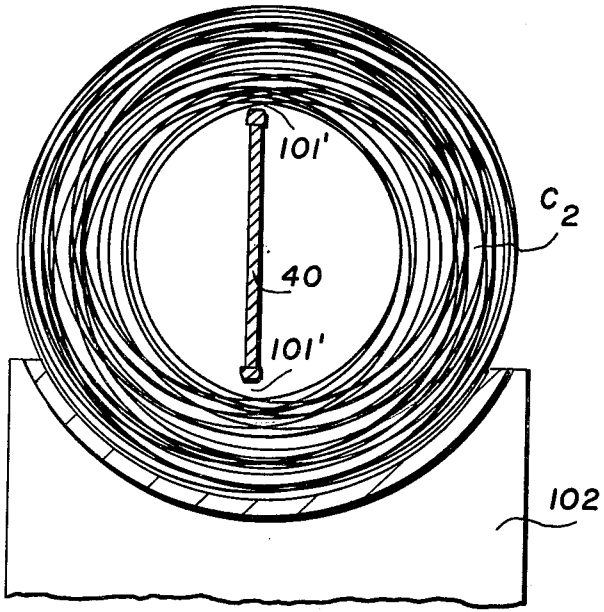
Figure 3A:
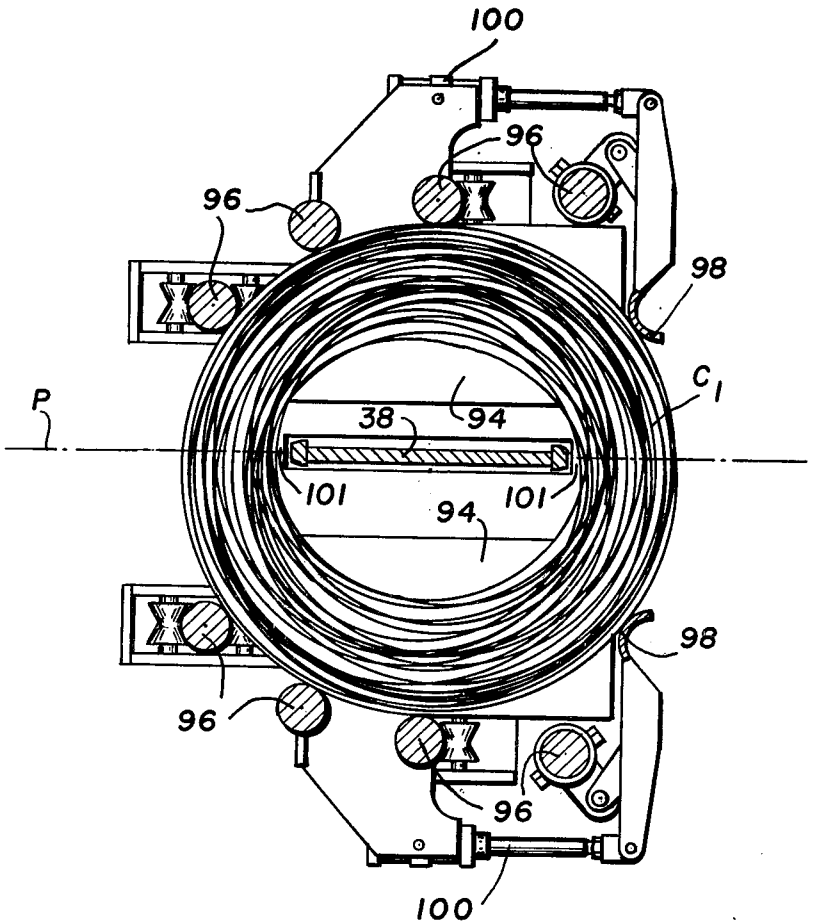

Referring in particular to FIG. 3A, it will be observed that the ability to radially confine the growing coil $C_1$ by means of a fixed posts 96 and adjustable gates 98 is to a large extent made possible because the mandrels move into and out of their operative positions at the coil forming station along a path generally depicted at "P". This external radial confinement is primarily responsible for establishing the shape of the coil, thus making it possible to loosely pack the rings around the mandrel, with spaces between individual rings being randomly provided as at 101. Referring additionally to FIG. 3B, it will be seen that when a coil $C_2$ is eventually deposited on a handling device such as the transfer car 102, the above-mentioned random spacing between the horizontally disposed mandrel and the inner coil rings is again reestablished at 101'. Thus, when the mandrel is axially withdrawn from the coil, frictional contact is minimized and damage to the rings is avoided.

The continued operation of the apparatus will now be described with further reference to the schematic illustrations in FIGS. 7A–7F. In this connection, it is to be understood that the combination of the transfer car 102 and vertically adjustable support rails 104 is intended only as a typical example of a system for receiving the fully formed coils at the coil delivery station $S_D$. Other known systems could also be employed as will be apparent to those skilled in the art.

FIGURE 7A

Rings continue to accumulate at $C_1$ around mandrel 38 on the gradually descending coil support plate 94. As this is occurring, and as previously described, the retraction device 80 operates in conjunction with the stop pin plungers 74, 76 to horizontally retract the mandrel 40 from the coil $C_2$ at delivery station $S_D$ to the intermediate station $S_I$.

FIGURE 7B

As coil $C_1$ continues to accumulate around mandrel 38 on the descending coil plate 94, transfer car 102 is shifted along rails 104 to a position underlying the hook 108 of a conventional hook carrier system. At this stage, although the hook has been inserted into the eye of the coil $C_2$, the coil remains supported on the transfer car 102.

FIGURE 7C

The linkage mechanisms 106 supporting the rails 104 are then actuated to lower the rails and the transfer car 102. This effectively transfers coil $C_2$ onto the hook 108.

FIGURE 7D

The transfer car 102 is returned to its coil receiving position at station $S_D$ and the loaded hook 108 is replaced by another empty hook 108'.

FIGURE 7E

Formation of coil $C_1$ around mandrel 38 has now been completed. Arresting fingers 110 have been moved into the delivery device 12 to temporarily interrupt further descent of rings. The coil support plate 94 has been lowered to deposit coil $C_1$ onto the hub 18 and the piston-cylinder unit 90 has been actuated to axially lower mandrel 38 so that its upper end will clear the bottom of the delivery device 12. Also, although not shown in this view, it will be understood that the piston-cylinder units 100 (see FIGS. 1–3) have been actuated to pivotally open the gates 98.

FIGURE 7F

Hub 18 is rotatably indexed through 90° to rotate mandrel 40 from a horizontally disposed position at the intermediate station $S_I$ to a vertically disposed position at the collecting station $S_C$. As mandrel 40 rotates between these two positions, it automatically disengages its nose 40c from the spring loaded jaws 84 of the retracted gripping head 82. Simultaneously, mandrel 38 is rotated to a horizontal position at the delivery station $S_D$ thereby depositing its coil $C_1$ on the awaiting transfer car. Both the mandrel 40 and coil support plate 94 are then vertically raised to appropriate levels prior to retracting the arresting fingers 110. The cycle then repeats itself as the coil $C_1$ on mandrel 38 is cleared from the apparatus and the next coil continues to accumulate around mandrel 40.

In light of the foregoing description, it will now be appreciated by those skilled in the art that the present invention embodies a number of advantageous features which are not to be found in known prior art devices. For example, the present invention employs a pair of axially adjustable mandrels mounted on a common rotatable hub, with the rotational axis of the hub and the mandrel axes being mutually perpendicular. The mandrels are contained in parallel planes and are each provided with opposite identical ends which can alternatively be employed to receive rings from an overlying delivery device. The mandrels are axially adjusted in relation to the central hub in a manner which eliminates any necessity for extensive and costly excavations. The mandrels are axially adjusted by means which are separate from and which remain fixed relative to the rotatable hub. All of these features contribute to the provision of a coil forming apparatus which operates efficiently and reliably, and which is relatively inexpensive to fabricate and install as compared with known prior art devices.

It is my intention to cover all changes and modifications of the apparatus herein disclosed which do not depart from the spirit and scope of the claims appended hereto.

I claim:

1. In a rolling mill wherein product rings are accumulated in coil form around mandrels mounted on a rotatable hub, with means for rotatably indexing the hub to move the mandrels between a collecting station at which the mandrels protrude vertically from the hub and the rings are axially received thereon from an overlying delivery device, and a discharge station at one side of the hub at which the mandrels protrude horizontally to accommodate axial removal of coils from the mandrels, the improvement comprising:

said mandrels being axially adjustable relative to said hub, each mandrel being provided with oppositely disposed ends adapted to receive rings axially from said delivery device; and, means for axially withdrawing each mandrel across the rotational axis of said hub from said discharge station to an intermediate station on the opposite side of said hub.

2. The apparatus of claim 1 wherein two of said mandrels are provided, with the axes of said mandrels and the rotational axis of said hub being arranged at ninety degree angles relative to each other.

3. The apparatus of claim 1 wherein said means consists of a clamp mechanism engageable with either of two nose portions located at opposite ends of each mandrel.

4. The apparatus of claim 3 wherein said clamp mechanism is reciprocally manipulated in opposite directions relative to said hub.

5. The apparatus of claim 3 wherein said clamp mechanism is engaged by being moved axially onto said nose portions, and wherein said nose portions are rotationally disengaged from said clamp mechanism during rotational movement of the mandrels from said intermediate position to said coil forming position.

6. The apparatus of claims 1 or 2 wherein said mandrels are arranged in parallel planes.

7. The apparatus of claim 1 further comprising means engageable with the lower end of a mandrel at said coil forming position to axially adjust said mandrel relative to said delivery device.

8. The apparatus of claim 1 wherein said mandrels are axially located relative to said hub by pin members mounted on said hub for reciprocal movement into and out of receiving apertures in said mandrels.

9. The apparatus of claim 8 wherein said pin members are reciprocally moved by means of operating plungers arranged to engage opposite ends of said pin members.

10. The apparatus of claims 8 or 9 wherein the receiving apertures of each mandrel are elongated in the direction of the mandrel axes to accommodate axial adjustment of the mandrels relative to the delivery device, and means underlying said hub and engageable with the lower end of a mandrel at said coil forming position for performing said axial adjustments.

11. In a rolling mill, apparatus for collecting a succession of previously formed product rings into coil form comprising:

a rotatable hub;

a pair of elongated mandrels mounted on said hub, each mandrel being axially adjustable relative to said hub and each having identical opposite ends, the arrangement of said mandrels being such that when the mandrel is positioned vertically to receive product rings at a collecting station, the other mandrel is positioned horizontally to accommodate removal of a completed coil therefrom at a discharge station on one side of said hub;

means for axially withdrawing each horizontally disposed mandrel through said hub from said discharge station to an intermediate station on the opposite side of said hub; and means for rotatably indexing said hub.

* * * * *